US005600861A

United States Patent [19]

Saito

[11] Patent Number: 5,600,861

[45] Date of Patent: Feb. 11, 1997

[54] CASTING FINISHING APPARATUS

[75] Inventor: Shoji Saito, Iwata, Japan

[73] Assignee: Yamaha Hatsudoki Kabushiki Kaisha, Iwata, Japan

[21] Appl. No.: 356,661

[22] Filed: Dec. 15, 1994

[30] Foreign Application Priority Data

Dec. 15, 1993 [JP] Japan ..... 5-315418

[51] Int. Cl.[6] ..... A46B 13/00

[52] U.S. Cl. ..... 15/88.2; 15/21.1

[58] Field of Search ..... 15/21.1, 88.1, 15/88.2, 88.3; 29/81.12, DIG. 7, DIG. 98; 72/40

[56] References Cited

U.S. PATENT DOCUMENTS 3,561,032 2/1971 Kasnyik et al. ..... 15/88.2
4,217,733 8/1980 Van Sickle ..... 15/88.2
4,406,029 9/1983 Kunz ..... 15/88.3

FOREIGN PATENT DOCUMENTS 1771827 10/1992 U.S.S.R. ..... 15/21.1

*Primary Examiner*—David Scherbel
*Assistant Examiner*—Randall E. Chin
*Attorney, Agent, or Firm*—Knobbe, Martens, Olson & Bear, LLP

[57] ABSTRACT

Several embodiments of burr removal arrangements for cleaning castings. The burr removal comprises one or more wire brushes that are spring biased into engagement with the casting surface. In some embodiments, there are a plurality of brushes, and adjacent brushes rotate in opposite directions.

4 Claims, 4 Drawing Sheets

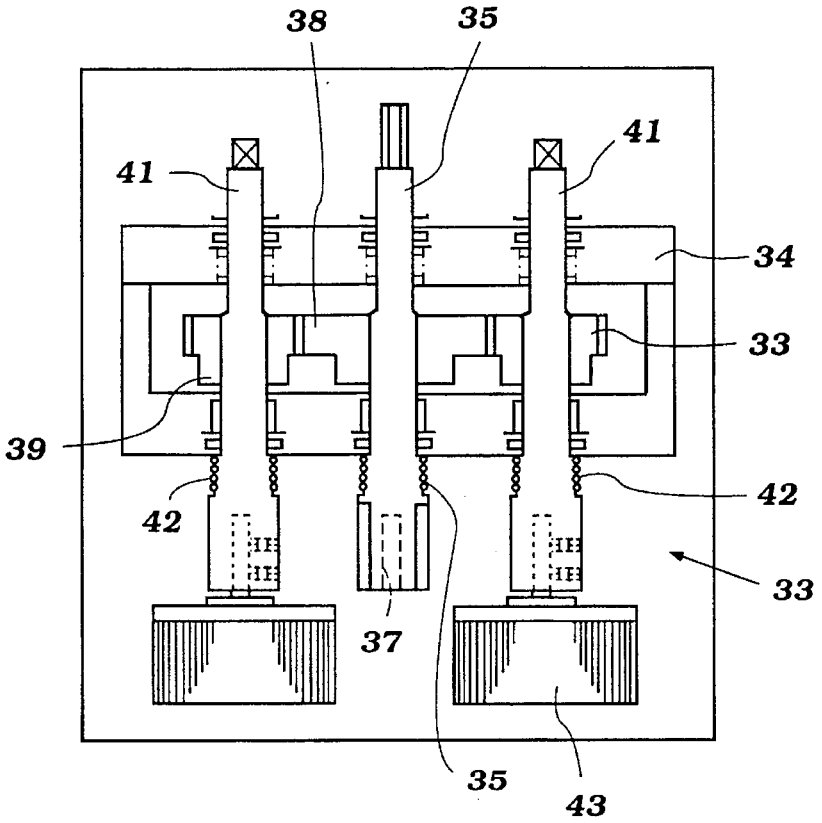
Figure 3
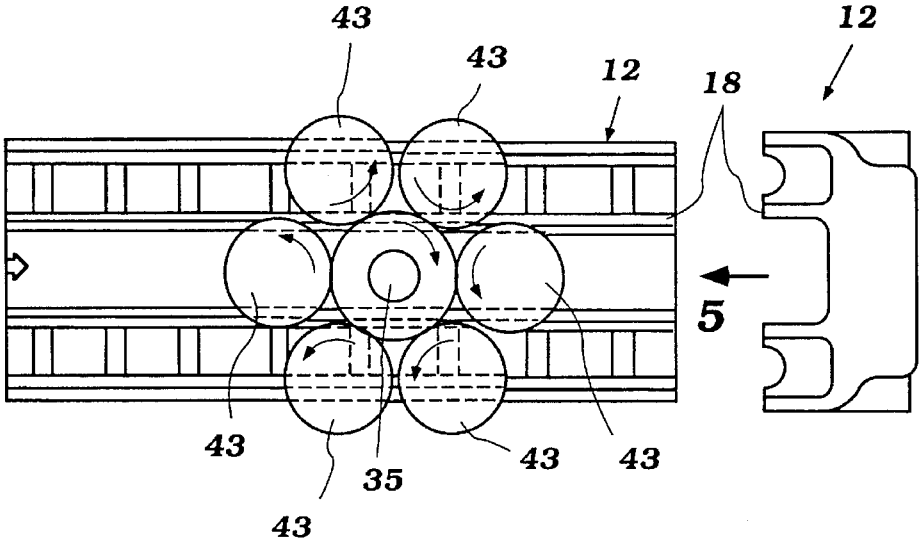
Figure 4
Figure 5

CASTING FINISHING APPARATUS

BACKGROUND OF THE INVENTION

The invention relates to a casting finishing apparatus and more particularly to an improved arrangement for cleaning burrs from castings.

As is well known, casting techniques are utilized for forming a wide number of parts, including components for engines. Regardless of the type of casting process employed, there are surface imperfections, such as burrs or flashing, that occur on the finished casting. It is desirable to remove these surface imperfections before any machining or final assembly of the casting takes place.

Conventionally, individual operators employing hand tools have been utilized to perform these casting cleaning techniques. Alternatively, the castings may be cleaned by some form of blasting process, but this has a number of disadvantages. First, the blasting equipment is expensive. Furthermore, the blasting equipment requires a closed environment and an air processing system to ensure that foreign particles used or formed during the blasting process do not escape into the surrounding area.

It is, therefore, a principal object of this invention to provide an improved and automated casting cleaning process.

It is a further object of this invention to provide an improved and simplified casting cleaning process for removing burrs after the casting has been formed and which can be done automatically and which employs multi-purpose machine tools as a driving force.

If a machine tool is employed for driving a cleaning device, such as a wire brush or the like, it is essential to ensure that the appropriate degree of pressure is exerted from the brush on the workpiece. The pressure should be great enough to ensure cleaning, but not so great as to mar the surface of the casting being cleaned.

It is, therefore, a further object of this invention to provide an improved wire brush cleaning arrangement that can be utilized for casting cleaning in machine tools, but wherein the pressure applied by the brush to the workpiece is controlled.

SUMMARY OF THE INVENTION

A first feature of this invention is adapted to be embodied in an apparatus for removing burrs from castings or the like. The apparatus comprises a fixture that is mounted so that the casting will move relative to it in an automatic fashion, and which fixture is driven by a machine tool. A plurality of wire brushes are journaled for rotation about parallel axes by the fixture and at least two adjacent brushes rotate in opposite directions.

Another feature of the invention is adapted to be embodied in a wire brush cleaning tool that is adapted to be mounted and driven in a multi-purpose machine. This tool includes an arbor that is adapted to be driven by the tool and which mounts a wire brush that rotates with the arbor. The wire brush is, however, resiliently supported relative to the arbor so that the pressure applied by the brush on the casting is controlled by the compression of the spring.

BRIEF DESCRIPTION OF THE DRAWINGS

FIG. 3 is an enlarged side elevational view, with portions broken away and shown in section, illustrating the upper surface cleaning apparatus.

FIG. 4 is a view taken generally in the direction of the arrow 4 in FIG. 1 and shows how the cleaning tool can be employed for cleaning the upper surfaces of the casting.

FIG. 5 is a view of the casting looking in the direction of the arrow 5 in FIG. 4.

DESCRIPTION OF THE PREFERRED EMBODIMENTS OF THE INVENTION

Figure 1:
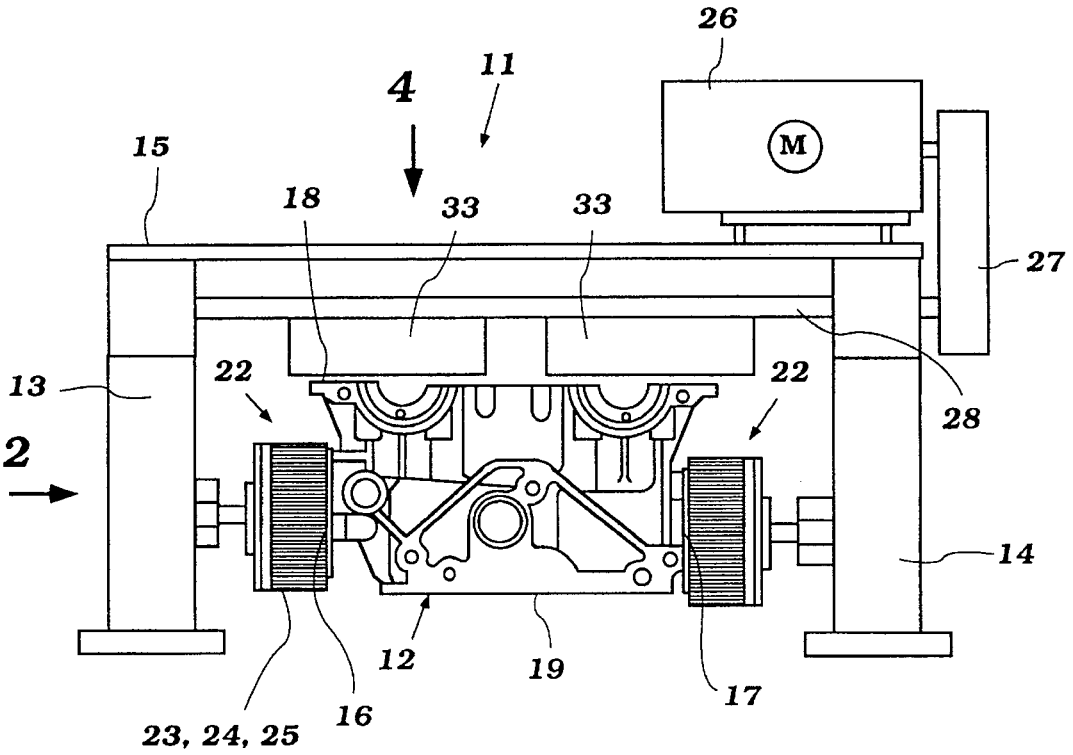
FIG. 1 is an end elevational view of a machine tool and casting cleaning apparatus constructed in accordance with an embodiment of the invention.

Referring now in detail to the drawings and initially to FIGS. 1–5, an automated casting cleaning apparatus constructed in accordance with an embodiment of the invention is illustrated and is identified generally by the reference numeral 11. This apparatus 11 is adapted to cooperate with a conveyor (not shown) on which castings, such as engine cylinder heads, indicated generally by the reference numeral 12, are conveyed through a casting cleaning area defined between a pair of upstanding posts 13 and 14 and a horizontally extending bridge portion 15. Any known type of conveyor can be employed for this purpose.

The cylinder head casting 12 is presented to the cleaning apparatus 11 so that its side surfaces, on which manifold receiving portions 16 and 17 will extend in a vertical direction, and an upper surface 18 which forms the cam towers for rotatably journaling a pair of camshafts (not shown) are provided. The cylinder head 12 further includes a lower surface 19 that is adapted to be mounted in sealing engagement with an associated cylinder block in final engine assembly.

Figure 2:
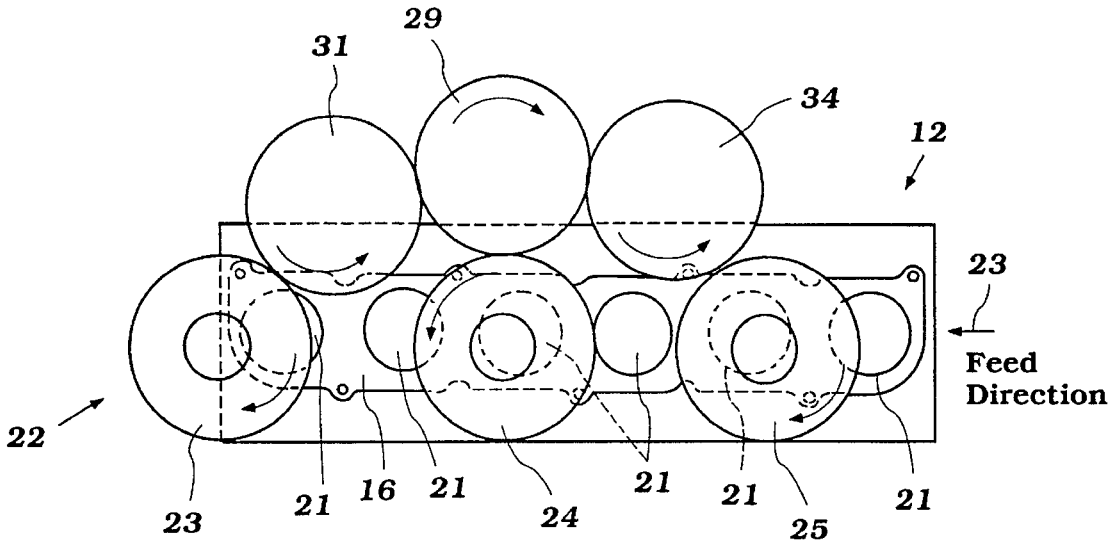
FIG. 2 is an enlarged view taken in the direction of the arrow 2 in FIG. 1 and shows the side casting cleaning apparatus.

The manifold receiving sections 16 and 17 on the sides of the cylinder head are formed with a plurality of ports, the ports 21 associated with the manifold section 16 being shown in FIG. 2. The area around these ports may be formed with burrs and it is essential that these burrs be removed before further machining operations or assembly take place. A pair of side cleaning fixtures, indicated generally by the reference numeral 22, are mounted on the posts 13 and 14 and engage the surfaces 16 and 17 as the cylinder head 12 moves through the cleaning apparatus in the direction of feed of the conveyor, indicated by the arrow 23 in FIG. 2. During this movement, the cleaning fixtures 22 will remove burrs and other surface imperfections.

Each cleaning fixture 22 includes a series of brushes, three being disclosed in this embodiment numbered 23, 24 and 25, that are supported for rotation about parallel axes. This rotational support may be provided directly in the respective posts 13 and 14. These brushes 23–25 are resiliently supported for movement transversely toward and away from the respective manifold receiving surfaces 16 and 17 in a manner which will be described by reference to FIG. 3.

A transmission assembly is provided within the fixture 22 and specifically within the respective posts 13 and 14 for driving the brushes 23, 24 and 25 so that adjacent brushes rotate in opposite directions. This drive includes an electric motor 26 that is rotatably supported on the upper end of the post 14 and partially on the cross-beam 15. The motor 26 drives a transmission 27 which, in turn, drives a drive shaft 28 that spans the posts 13 and 14 and drives a further transmission therein which includes a driving gear 29 of the spur type for each fixture 22, as seen in FIG. 2. This driving gear 29 drives a gear associated with the brush 24 so that the brush 24 will rotate in an opposite direction from the drive gear 29. In the illustrated embodiment, the drive gear 29 rotates in a clockwise direction while the brush 24 rotates in a counter-clockwise direction.

A pair of idler gears 31 and 32 are driven by the drive gear 29 and, in turn, drive gears (not shown) that are affixed to and drive the brushes 23 and 25. As a result, the brushes 23 and 25 will rotate in the same direction as the drive gear 29 and in opposite direction of the intermediate brush 24. This opposite degree of rotation has been found to significantly improve the cleaning. Thus, as a given portion of the surface of the manifold section 16 traverses the brushes, it will first be cleaned by the brush 25 rotating in one direction, then by the brush 24 rotating in the opposite direction, and finally by the brush 23 which rotates oppositely the brush 24 and in the same direction as the brush 25.

The brush assembly 22 associated with the post 14 has the same construction and drive arrangement. However, the fixture 22 may be positioned at a different vertical height due to the respective locations of the manifold receiving surfaces 16 and 17 at the opposite sides of the cylinder head 12.

One or more upper cleaning fixtures 33 are mounted on the cross-beam 15 and driven by the drive shaft 28 for cleaning the upper cylinder head surface 18. In FIG. 1, two such fixtures are illustrated, but FIGS. 3–5 show a single fixture 33 for this purpose. It should be readily apparent to those skilled in the art how the device can be used with either one or more fixtures. These figures, and specifically, FIG. 3, also show how the cleaning brushes may be supported for spring biased engagement with the surface 18 and, as previously noted, a similar arrangement may be employed with the brushes 23, 24 and 25.

The fixture 33 includes a housing assembly 34 in which a first drive arbor 35 is supported for rotation. This drive arbor 35 is also movable along its rotational axis relative to the housing 34 and is biased downwardly toward the cylinder head surface 18 by a coil compression spring 36. The arbor 35 has a socket 37 that is adapted to receive a wire brush, which is eliminated in this figure, but which is shown in FIG. 4. The arbor 35 has a splined engagement to a drive gear 38 that is rotatably journalled within the housing assembly 34. This splined connection permits the arbor 35 to slide axially relative to the gear 38. The gear 38 is enmeshed with a plurality of gears 39, each of which has a splined connection to a further arbor 41. The arbors 41 are spaced transversely around the arbor 35, but rotate about axes that are parallel to the axis of rotation of the arbor 35. Like the arbor 35, the arbors 41 are engaged by coil compression springs 42 so as to urge wire brushes 43 carried thereby into engagement with the cylinder head surface 18 for its cleaning.

Because of the drive arrangement employed in this assembly, the center brush associated with the arbor 35 will rotate in an opposite direction from the remaining brushes 43. Therefore, the cylinder head surfaces will be cleaned by the counter-rotating brushes where they contact the surface 18. If desired, another drive arrangement may be employed wherein the brushes 43 rotate in opposite directions from each other, and those skilled in the art can readily understand how to provide such a transmission arrangement.

Figure 6:
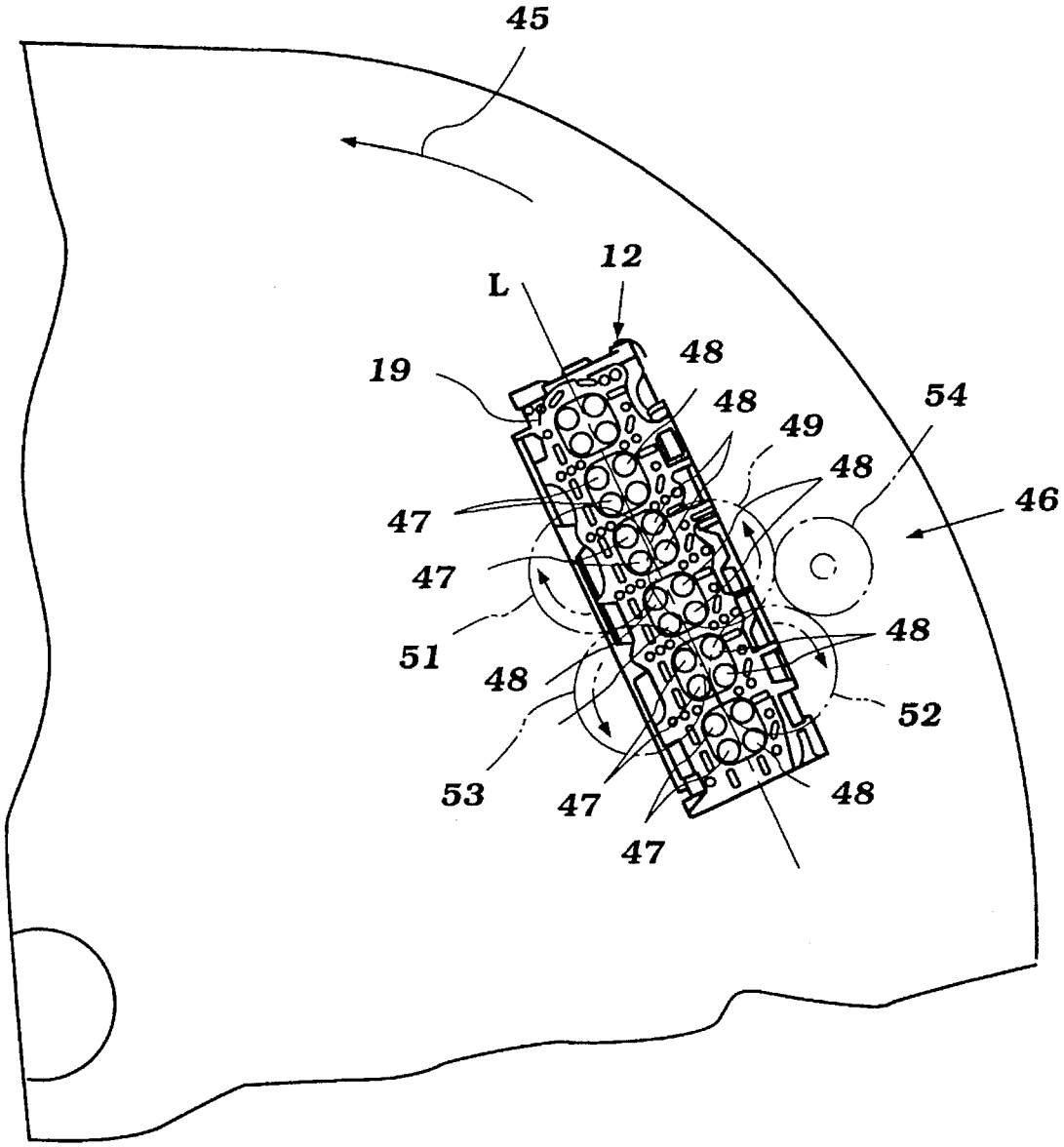
FIG. 6 is a top plan view showing a further apparatus for cleaning the lower surface of the casting.

Thus, the cylinder head surfaces 16, 17 and 18 are cleaned as they pass through the tool 11. This leaves only the surface 19 to be cleaned, and this is cleaned in a manner as shown in FIG. 6. The cylinder head casting 12 is removed from the conveyor and placed on a rotary table 44 by means of a suitable mounting fixture (not shown) with the surface 19 facing upwardly. This mounting fixture 44 rotates in the direction shown by the arrow 45 and thus passes beneath a cleaning fixture, which is shown in phantom and is identified by the reference numeral 46.

It should be noted that the lower cylinder head surface 19, which is adapted to be in sealing engagement with an associated cylinder block, is formed with combustion chamber recesses in which intake valve seats 47 and exhaust valve seats 48, formed at the termination of the passages that extend through the manifold receiving surfaces 16 and 17, respectively, are formed. These valve seats 47 and 48 are disposed generally on opposite sides of a longitudinally extending plane L passing through the center of the cylinder head 12.

The surface cleaning fixture 46 is comprised of four brushes 49, 51, 52 and 53, all of which are mounted in a manner as shown in FIG. 3 so as to be spring biased toward the cylinder head surface 19. The brushes 49, 51, 52 and 53 rotate about respective parallel axes and are driven by a drive gear 54, which, as has been noted, is driven in a suitable manner. The drive gear 54 is enmeshed with a gear that is carried by the brush 49 so that the brush 49 will rotate in an opposite direction from the drive gear 54, this direction of rotation being counter-clockwise in the illustrated embodiment. The gear associated with the brush 49 drives a gear associated with the brush 51 and a gear associated with the brush 52 so that the adjacent brushes 51 and 52 will rotate in an opposite direction (clockwise) from the brush 49.

The remaining brush 53 has a gear which is enmeshed with either the gear associated with the brush 51 or the gear associated with the brush 52 so that the brush 53 will rotate in an opposite direction from its adjacent brushes. Hence, the cylinder head surface 19 is cleaned effectively by this counter-rotating brushes.

Figure 7:
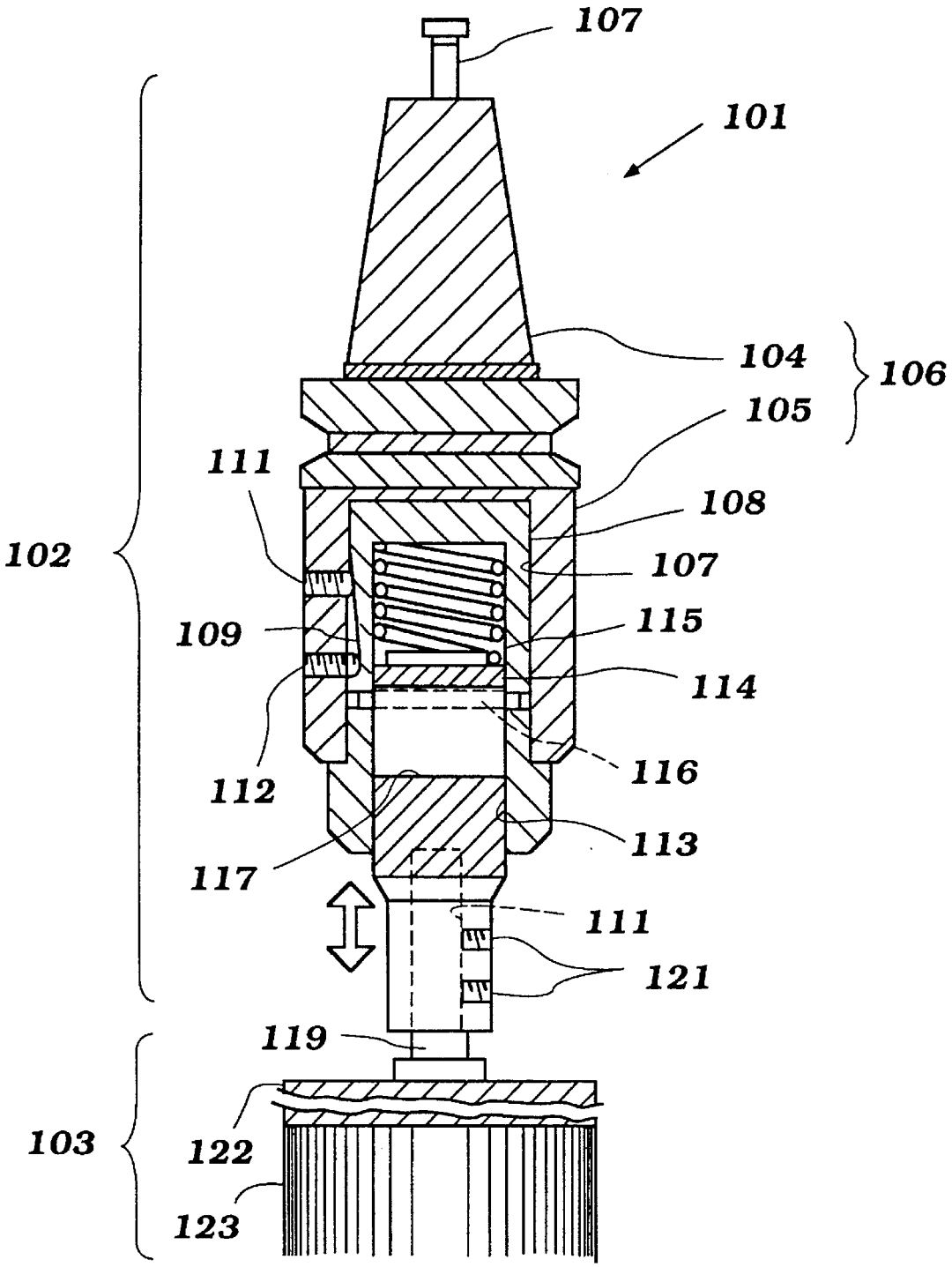
FIG. 7 is an enlarged cross-sectional view showing how one of the cleaning tools can be mounted in a fixture so that it can be employed with a multiple purpose machine tool.

In the embodiments of the invention as thus far described, the cleaning brushes have been mounted in individual fixtures, which fixtures are, in turn, driven in a suitable manner. FIG. 7 shows another embodiment of the invention, and illustrates a cleaning brush assembly 101 that is adapted to be mounted in a multi-purpose machine tool so as to provide a cleaning operation. The assembly 101 includes a mounting arbor portion 102 and a brush portion 103, each having a construction as will be described.

The arbor portion 102 is comprised of a base housing that includes a tapered shank 104 and a cylindrical portion 105 that form a housing assembly 106. A shaft portion extends from the shank 104 and provides a detachable connection to the associated machine tool so that the arbor 102 will be rotated by it.

The cylindrical portion 105 is formed with a cylindrical bore 107 which receives a cylindrical element 108 which, in turn, carries the brush 103 in a manner which will be described. The cylindrical housing 106 is formed with a recess 109 that receives a pair of set screws 111 and 112 carried by the housing cylindrical portion 105 so as to establish a detachable driving connection between the arbor 102 and the housing 108.

The housing 108, in turn, defines a cylindrical bore 113 in which a cylindrical brush carrier housing 114 is received. A coil compression spring 115 is loaded between the base of the bore 113 and an end of the brush carrier 114 so as to normally urge the brush carrier 114 in a downward direction. A transverse pin 116 extends through a slot 117 in the cylindrical member 114 so as to establish a driving connection between the arbor 102 and the brush carrier 114, and also so as to limit the degree of downward movement of the brush 103, as shown in FIG. 7.

The brush carrier 114 is formed with an opening 118 that receives the shank 119 of the brush 103. A pair of set screws 121 lock the brush shank 119 in position and establish a rotating drive connection with it. The brush 119 has a base 122 from which the wire bristles 123 extend. As may be best seen in this figure, the wire bristles 123 are arranged so that those at the outer periphery of the base 122 are spaced more closely to each other and hence, are denser than those disposed radially inwardly of the base. The wire bristle density decreases progressively toward the center of the brush 103 and the area immediately adjacent the shank 119 may be devoid of any bristles. This type of brush configuration as been found to provide excellent cleaning and the brushes of all of the previously described embodiments may be so formed.

As should be readily apparent when the tool 101 is mounted in a multi-purpose tool, the brush bristles 123 may be brought into engagement with the casting to be cleaned. The spring 115 will compress and will determine the pressure which the cleaning bristles 123 exert on the casting.

From the foregoing description, it should be readily apparent that the described embodiments provide a very effective automated casting cleaning apparatus that will provide good cleaning, permit ease of brush removal for servicing and which will eliminate hand tasks and less environmentally desirable cleaning methods. Of course, the foregoing description is that of a preferred embodiment of the invention, and various changes and modifications may be made without departing from the spirit and scope of the invention, as defined by the appended claims.

I claim:

1. An apparatus for removing burrs from castings, comprising a fixture adapted to be mounted relative to the casting for relative movement between said fixture and said casting, said fixture comprising a transmission driven by a machine, and a plurality of wire brushes journaled for rotation about parallel axes by said fixture in facing relation to the casting and spring biased relative to the casting for controlling the force applied to the casting by said brushes, said brushes being driven by said transmission, said plurality of wire brushes including at least two adjacent brushes rotated in opposite directions by said transmission.

2. The apparatus of claim 1, wherein the brushes are detachably connected to the fixture.

3. The apparatus of claim 2, wherein the biasing spring means is interposed between the fixture and the wire brush.

4. The apparatus of claim 1, wherein the casting is moved rectilinearly relative to the fixture for cleaning.

* * * * *